United States Patent [19]

Lonardo

[11] Patent Number: 4,470,775

[45] Date of Patent: Sep. 11, 1984

[54] SUBMERSIBLE DEEP WELL PUMP

[76] Inventor: Vincent P. Lonardo, 2642 Salt Springs Rd., Girard, Ohio 44420

[21] Appl. No.: 413,735

[22] Filed: Sep. 1, 1982

[51] Int. Cl.[3] ..... F04B 21/02; F04B 39/10

[52] U.S. Cl. ..... 417/569

[58] Field of Search ..... 92/85 B; 417/559, 552–554, 417/526–528, 254, 259, 260, 265, 267, 431, 433, 444, 459, 460

[56] References Cited

U.S. PATENT DOCUMENTS 3,677,141 7/1972 Lagerquist et al. ..... 92/85 B
4,048,905 9/1977 Souslin ..... 92/85 B
4,067,667 1/1978 White ..... 92/85 B
4,137,017 1/1979 Lonardo ..... 417/559 X

*Primary Examiner*—Edward K. Look
*Attorney, Agent, or Firm*—Harpman & Harpman

[57] ABSTRACT

A submersible deep well pump having a movable hollow piston with a secondary piston formed thereon, the piston being slidably positioned within two interconnecting chambers, each chamber having a check valve where movement of the piston displaces liquid alternately opening and closing the check valves moving the liquid progressively through the chambers into the hollow piston and to the surface.

3 Claims, 3 Drawing Figures

SUBMERSIBLE DEEP WELL PUMP

BACKGROUND OF THE INVENTION (1) Technical Field

This invention relates to submersible deep well pumps of the type employed to pump oil from wells.

(2) Description of the Prior Art

Prior art devices of this type have used a variety of different designs to displace liquid by piston pumps and check valves. See for example U.S. Pat. Nos. 356,750, 445,962, 814,312 and applicant's own U.S. Pat. No. 4,137,017.

In U.S. Pat No. 445,962, a pump is disclosed having a three-chamber configuration with a pump rod and float valve.

U.S. Pat. No. 356,750 discloses a pump with a piston tube that displaces fluid through check valves to the surface.

In U.S. Pat. No. 814,312, a pump is shown having a pump plunger rod moving within a cylinder with a pair of check valves regulating the flow of fluid within the chamber and up the pump plunger rod.

Applicant's U.S. Pat. No. 4,137,017 discloses a deep well submersible pump having a hollow piston rod which displaces oil through a check valve and up the hollow piston rod itself.

Applicant's present invention utilizes an apertured hollow piston rod with a secondary piston secured thereon and a series of vents, which in combination provide a hydraulic spring action to limit the travel of the hollow piston rod by utilizing the pressure within the well, the weight of the string and an outside pressure source to move the oil to the surface.

SUMMARY OF THE INVENTION

Figures 1, 2, 3:
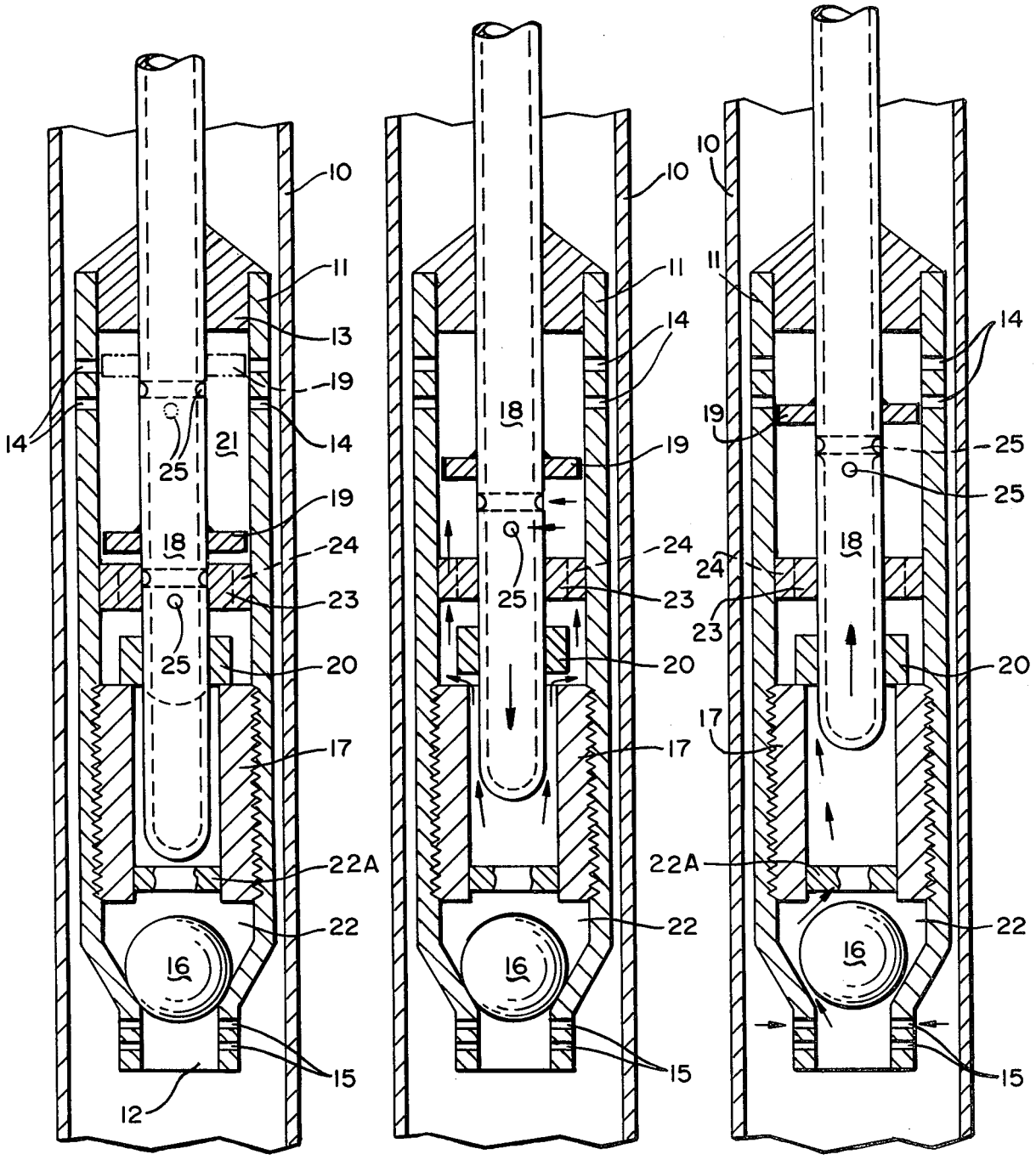
FIG. 1 is a cross sectional view of a pump with the piston beginning its downstroke.
FIG. 2 is a cross sectional view of a pump with the piston completing its upstroke.
FIG. 3 is a cross sectional view of a pump with the piston at the bottom of its downstroke with broken lines showing the secondary piston in its maximum upstroke position.

A submersible deep well pump has a movable hollow piston for slidable movement within two chambers, each having a check valve. A secondary piston is mounted on the hollow piston. The displacement of fluid within the chambers by the hollow piston alternately opens and closes the check valves directing the flow of fluid to the surface. The secondary piston acts as a hydraulic spring limiting the maximum upward travel of the hollow piston and venting the pump through a plurality of apertures in the upper chamber preparing the pump for the next cycle.

DESCRIPTION OF THE PREFERRED EMBODIMENT

The submersible deep well pump as seen in FIGS. 1 and 2 and 3 of the drawings is shown in a casing 10 in an oil well and comprising a cylinder 11 having an open lower end 12 and a closed upper end 13. Pairs of apertures 14 are formed in the cylinder 11 adjacent its closed upper end 13. Apertures 15 are formed in the cylinder 11 adjacent its lower open end. An area of reduced diameter in the lower open end 12 of the cylinder 11 holds an upwardly opening spherical check valve 16 therein. An externally threaded cylindrical insert 17 within the lower end of the cylinder 11 defines an area of increased wall thickness and reduced interior diameter through which a hollow piston 18 is slidably positioned. A secondary piston 19 extends outwardly from the surface of the hollow piston 18 and is positioned thereon at a point midway of the length of the hollow piston 18 defined within the cylinder 11. A ring check valve 20 is movably positioned on the upper end of the cylindrical insert 17 and divides the cylinder 11 into upper and lower chambers 21 and 22. An annular bushing 23 has a plurality of vertical grooves 24 formed around its outer edge and divides the upper chamber and restricts the vertical movement of the ring check valve 20 and determines the maximum downstroke of the hollow piston 21. A bar 22A in the end of the cylindrical insert 17 restricts the movement of the spherical check valve 16 within the lower chamber 22.

In operation, the hollow piston 18 as seen in FIG. 3 of the drawings, is at the limit of its downstroke shown in solid lines, and broken lines show the uppermost position of the secondary piston 19.

Referring to FIG. 2 of the drawings, the upward movement of the hollow piston 18 causes a decrease in pressure within the lower chamber 22 opening the spherical check valve 16 and drawing oil through the apertures 15 and lower end 12 to fill the chamber 22. The oil opens the ring check valve 20 which is normally closed. When the hollow piston 18 reaches its maximum upstroke position the secondary piston 19, as seen in broken lines of FIG. 3 of the drawings, travels past the lower pair of apertures 14 exposing the same to unload or vent. The secondary piston 19 then engages the upper pair of apertures 14 sealing the same and trapping fluid between said secondary piston 19 and the closed upper end 13 stopping the hollow piston 18 by a hydraulic spring action.

The piston 18 has spaced apertures 25 just below the secondary piston 19. In FIG. 1 of the drawings, downward movement of the hollow piston 18 into the lower chamber 22 increases the oil pressure therein closing the spherical check valve 16 and opening the ring check valve 20 so that the displaced oil moves into the upper chamber 21 through the grooves 24 in the annular bushing 23 and the apertures 25 into the hollow piston 18.

As the hollow piston 18 nears its maximum downstroke, as seen in FIG. 3 of the drawings in solid lines, the apertures 25 are sealed by the annular bushing 23 increasing the oil pressure in the upper chamber 21 closing the ring check valve 20 and stopping the secondary piston just short of contact with the annular bushing 23.

The hollow piston 18 is attached to a pipe string and in its preferred form is reciprocated by the difference between the well pressure, the weight of the pipe string, and added fluid pressure therein from a source above ground, such as a hydraulic pump.

Thus it will be seen that the reciprocal motion imparted to the hollow piston 18 of the submersible deep well pump moves oil from the well because of the displacement of the oil in the chamber 22 on the downstroke of the hollow piston 18 moving the oil up through the ring check valve 20 and the annular bushing 23 into the hollow piston 18 and accordingly into the pipe string to which it is attached and which pipe string extends to the surface.

The secondary piston 19 acts as a hydraulic spring limiting the travel of the hollow piston 18 on the downstroke and upstroke while also controlling the upper chamber through the apertures 14 on the upstroke preparing the pump for the next cycle.

Thus it will be seen that a new and useful deep well submersible pump has been illustrated and described and it will be apparent to those skilled in the art that various changes may be made herein without departing from the invention.

Having thus described my invention what I claim is:

1. In a submersible deep well pump having a vertically disposed cylinder open at its lower end, a check valve in said cylinder defining upper and lower chambers, an upwardly opening check valve in the lower portion of said lower chamber, a hollow piston positioned in said cylinder slidably engaging said check valve defining said upper and lower chambers so as to be movable partially into and out of the lower one of said chambers, said hollow piston having apertures therein communicating with the upper one of said chambers, movement of said hollow piston downwardly into said lower chamber displacing fluid therein upwardly through said check valve defining said upper and lower chambers and into said upper chamber and movement of said piston upwardly in said lower chamber moving fluid into said lower chamber upwardly through the check valve in the lower portion of said lower chamber, and wherein movement of said hollow portion downwardly into said lower chamber displaces the fluid in said upper chamber into said hollow piston through said apertures, an area of reduced diameter at the lower end of said cylinder forming a seat for said check valve in the lower chamber, an apertured upper end member in said vertically disposed cylinder through which said hollow piston moves, an annular bushing positioned inwardly of the ends of said cylinder, a cylindrical insert in said lower chamber forming a seat for said check valve defining said upper and lower chambers, an annular secondary piston affixed to the exterior of said hollow piston above said apertures therein and positioned for sealing engagement with openings in said vertically disposed cylinder.

2. The improvement in a submersible deep well pump set forth in claim 1 and wherein said check valve defining said upper and lower chambers is positioned below said annular bushing and said annular secondary piston on the exterior of said hollow piston forms a hydraulic spring above said annular bushing limiting the travel of the hollow piston in a downward direction in said cylinder.

3. The improvement in a submersible deep well pump set forth in claim 1 and wherein said openings in said vertically disposed cylinder adjacent its uppermost end are arranged on two vertically spaced levels so that fluid moved in said upper chamber by said secondary piston is forced outwardly through said openings immediately prior to said secondary piston's sealing engagement therewith in forming said hydraulic spring limiting the travel of the hollow piston in an upward direction of the cylinder.

* * * * *